United States Patent [19]

Yngve et al.

[11] Patent Number: 4,802,330

[45] Date of Patent: Feb. 7, 1989

[54] COMBINED CARPET YARNS BY OPEN END ROTOR SPINNING

[75] Inventors: Paul W. Yngve, Wilmington, Del.; Peter Artzt, Reutlingen, Fed. Rep. of Germany; Gerhard Egbers, Reutlingen, Fed. Rep. of Germany; Ullrich Stark, Stuttgart, Fed. Rep. of Germany; Heinz Müller, Metzingen-Neuhausen, Fed. Rep. of Germany

[73] Assignee: E. I. Du Pont de Nemours and Company, Wilmington, Del.

[21] Appl. No.: 95,224

[22] Filed: Sep. 11, 1987

Related U.S. Application Data

[62] Division of Ser. No. 4,608, Jan. 20, 1987, Pat. No. 4,729,214.

[51] Int. Cl.[4] ..... D02G 3/38

[52] U.S. Cl. ..... 57/238

[58] Field of Search ..... 57/210, 224, 225, 226, 57/227, 228, 238, 243, 244, 3, 5, 6, 12, 400, 404, 408, 409, 411, 417

[56] References Cited

U.S. PATENT DOCUMENTS

| | | | |
|---|---|---|---|
| 2,123,261 | 7/1938 | Taylor et al. | 57/238 |
| 3,445,993 | 5/1969 | Vorisek | 57/6 |
| 3,495,393 | 2/1970 | Wada et al. | 57/227 |
| 4,083,173 | 4/1978 | Artzt et al. | 57/58.95 |
| 4,219,996 | 9/1980 | Edgawa et al. | 57/225 |
| 4,302,925 | 12/1981 | Edagawa et al. | 57/409 X |
| 4,302,926 | 12/1981 | Maixner et al. | 57/58.95 |
| 4,364,223 | 12/1982 | Vignon | 57/5 |
| 4,411,129 | 10/1983 | Parker et al. | 57/228 |
| 4,527,384 | 7/1985 | Stejskal et al. | 57/404 |

FOREIGN PATENT DOCUMENTS

| | | | |
|---|---|---|---|
| 19653 | 7/1975 | Japan | 57/226 |
| 52-67387 | 12/1977 | Japan . | |
| 1495713 | 12/1977 | United Kingdom . | |

OTHER PUBLICATIONS

Production of Wrap-Spun OE Rotor Yarns and their Application, by Z. Miklas-Melliand Textilberichte, pp. 10-16 (Eng. Ed.) Jan. 1984.

*Primary Examiner*—Donald Watkins

[57] ABSTRACT

A method for manufacturing a combined yarn, by open end rotor spinning, suitable for use in carpets is disclosed.

9 Claims, 4 Drawing Sheets

COMBINED CARPET YARNS BY OPEN END ROTOR SPINNING

This is a division of application Ser. No. 004,608, filed Jan. 20, 1987, now Pat. No. 4,729,214.

DESCRIPTION

Technical Field

This invention relates generally to combined carpet yarns made by open end rotor spinning.

BACKGROUND

Yarns to be used as pile in cut pile carpets are currently 2-ply twisted for aesthetics and heat set in the plied condition to retain their twist when cut and subjected to normal wear. The feed yarns can be either continuous filaments or spun yarns. In the most common plying method, (cable twisting), two yarns either continuous filament or spun yarns are twisted together resulting in a yarn having zero twist in each component yarn. However, such twist plying has low productivity for two reasons; first, it is a slow operation limited to about 35 ypm by centrifugal force considerations and second, it is discontinuous due to the need to replace yarn packages in the bucket of the plying equipment. A faster more economical and more flexible continuous operation to make such yarns is greatly desired.

Carpet staple spun yarns used to feed the plying process are typically produced by ring spinning or wrap spinning processes. In ring spinning, production speeds are limited by the flyer to approximately 35 to 40 ypm. In wrap spinning, production speeds are limited by the spindle to approximately 100 ypm. Both of these processes are discontinuous (reducing throughput) by the wound package (ring spinning) or spindle package (wrap spinning).

Each yarn from the processes have unique characteristics. The ring spun yarns have a minimum number of staple fibers per cross section (typically 80 to 100) and a minimum twist level (>1 tpi) to develop proper yarn tenacity for processing. The wrap spun yarns have zero twist spun yarn core over wrapped by a light denier continuous filament yarn to achieve proper tenacity. The wrap spun yarn also requires a minimum number of staple fibers per cross section (80–100) for processability.

Staple spun yarns used for carpets should desirably have as much bulk as possible to hide the backing and resist crushing loads. This bulk is mainly contributed by crimp introduced into synthetic fibers by one of several processes. However, these staple spun yarns require a substantial amount of real twist to hold the fibers together and contribute the tenacity necessary to wind and unwind the yarn and to weave or tuft it into carpet backing. Such twisting compresses the fibers laterally and reduces their bulk. Bulk is also contributed by the retraction and crimp member displayed by such fibers during hot wet processing of the yarns or carpets during twist setting, scouring and dyeing, but such crimp recovery is also inhibited by a high degree of twist.

Furthermore, the tenacity of such staple yarns depends also on the number of fibers in a given cross section of the yarn and on their length. It is known that a given number of long fibers makes a stronger yarn than short fibers at a given twist level, but strength also depends on the number of fibers which contribute the necessary frictional forces between fibers.

Large diameter crimped fibers resist compression and retain bulk better than small fibers, but large fibers must be fewer in number to make a yarn of given total size. Thus, the number of such large fibers may be too few to give adequate strength at a given amount of twist and a certain fiber length, when staple yarns are formed by twisting in the conventional manner.

A technique developed in the 1960's called rotor spinning or open end spinning feeds staple fibers to the inside wall of a cup-shaped rotor operating at high speed where centrifugal force compacts the fibers into a consolidation groove, then the fibers are led inward toward the axis of rotation and are removed through an axial passage. The rotation of the rotor twists the yarn to a degree dependent on the revolutions of the rotor and the removal speed, higher removal speed giving lower real twist of the fibers for a given rotational speed. Rotational speed is limited partly by the strength of the rotor but in practice is more often limited by the ability of the twisted staple to bear the tension required to counteract centrifugal force while removing it from the rotor groove. A low degree of real twist may produce a yarn which is too weak to be removed when the false twist after the navel has disappeared.

SUMMARY OF THE INVENTION

It has now been found that combined yarns suitable for use in carpets and upholstery, having adequate tenacity, cohesion and aesthetics may be formed at higher speed by passing a continuous filament yarn preferably a crimped continuous filament yarn, having a denier of 20–2500 under tension, through a hollow spindle of an open end spinning rotor having a consolidating groove; feeding crimped staple fibers of about 6–34 denier per fiber and about 75–200 mm length, preferably 75–140 mm, into the consolidating groove of the open end spinning rotor; twisting the staple fibers during passage of the staple fibers from the consolidating groove to a grooved navel surrounded by said rotor; combining the continuous filament yarn and the staple yarn in the navel; adjusting the continuous filament yarn feed rate to form a combined yarn having a balanced ply whereby the combined yarn has a mechanical twist of 1.5–7 tpi, preferably 3–4 tpi; and removing the combined yarn at a speed of preferably at least 120 meters per minute. The length of the staple fibers is preferably about 50–120% of the rotor diameter. The navel is a stationary funnel shaped entrance to an exit passage coaxial with the rotor and has grooves that extend from the inner radius to the outer radius having preferably 2–16 grooves. The navel imparts false twist to the staple yarn while the staple yarn is plying with the continuous filament yarn.

The continuous filament yarn passes into the rotor through an axial passage which is preferably rotating with the rotor. This rotation causes false twist, which migrates against the feeding direction in the continuous filament.

The balanced ply of the combined yarn is formed by the staple and continuous filament yarns each formed a helical path around the axis of the plied yarn as opposed to one yarn being a core yarn and the other yarn being the wrap yarn. The feed rate of the continuous filament yarn differs from the take-away rate of the combined yarn by less than 10% and is preferably 1–3% greater than the take-away rate.

The continuous filament yarn is less than 0.4% longer than the staple yarn when unplied and can be up to 10% shorter. It is preferably 0.02% to 0.15% longer when measured by the Differential Length Test.

An interlace jet can be added to the process between the exit of the rotor and winding. This jet is added to consolidate the staple fiber free ends into the combo yarn without destroying the aesthetic structure of the yarn. For some applications the entanglement could stabilize the staple of the twisted combo yarn structure.

The combined yarns of this invention are suitable for use in carpets and upholstery, have continuous filament yarn and staple yarn and are characterized by the staple fibers being rotor spun and having staple fibers 75–200 mm in length preferably 75–140 mm; a balanced ply; the combined yarn having a mechanical twist of 1.5–7 tpi preferably 3–4 tpi; and the staple fibers having a denier per fiber of 6–34. The continuous filament yarn is preferably less than 0.4% longer than the staple yarn. The combined yarn preferably has less than 120 staple fibers per cross section and more preferably about 70–110 staple fibers per cross section. The continuous filament yarn is preferably crimped.

In the products of the invention, the mechanical twist in the staple yarn is much lower than conventional for rotor spun staple yarns, permitting the staple to retain and recover much more crimp, the continuous filament yarn furnishing sufficient tenacity to compensate for the lower tenacity of the staple yarn particularly when fewer but heavier denier staple fibers than conventional are employed at lower twist. The mechanical twist of the combined yarn is preferably less than the mechanical twist at break of a staple yarn rotor spun separately at the same machine settings as exemplified in FIGS. 6 and 7.

The continuous filament can be any material which has the tenacity necessary to achieve the desired processing speed increases and the crimping/dyeing properties to achieve the desired plied aesthetics. Thus, a low denier continuous nylon yarn can be combined with crimped nylon staple for velour carpets and high denier bulk continuous filament (BCF) nylon yarn can be combined with nylon staple for saxony carpets, as can polyesters, polypropylene, spandex, etc.

Any natural or synthetic fibers or blends thereof may be used as the staple component, those fibers which lose bulk most easily when twisted to conventional degrees benefitting most from use in the present invention. Fibers having lower tenacity than normal may be used as all or a portion of the staple since the continuous filament component furnishes most of the tenacity required of the final combined yarn product, however all or a portion of the staple component must have sufficient tenacity to avoid breaking in the zone between the rotor groove and the navel. Such requirement may be determined by experimentation. Fibers of lower melting point than the continuous filament or the staple may be added to the continuous filament or staple to contribute unusual tuft cohesion after the yarn is heat set. A lower melting point staple fiber could potentially fuse some filaments and avoid the necessity of heat setting.

The synthetic polymeric staple fibers conventionally used for carpets is about 165–190 mm in length, while that preferred for the present invention is somewhat shorter unless a very large diameter rotor is used. Bulked continuous filament yarn which has been cut to staple fibers usually has greater bulk than conventional staple fibers when used in the present yarns.

One advantage of this invention is that the combined yarn of this invention can be directly tufted into carpets whereas ring spun yarn, wrap spun yarn and conventional rotor spun singles yarn must be plied before made into carpets.

A staple yarn component of a combined yarn which has been made by rotor spinning can be distinguished by the presence of fiber ends which wrap completely around the staple component two or more times about every 0.5 to 2.0 cm along the yarn length.

DETAILED DESCRIPTION OF THE DRAWINGS

Figure 1:
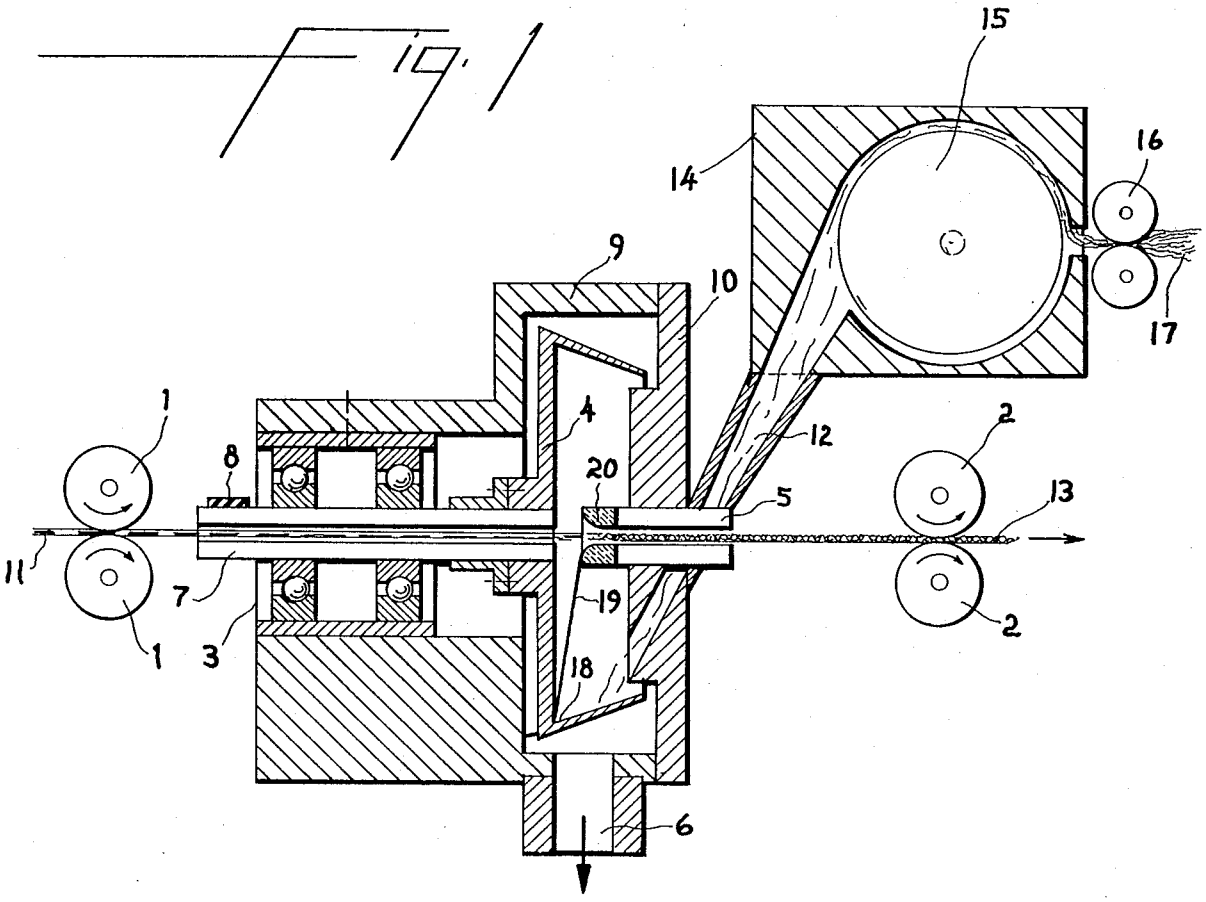
FIG. 1 is a schematic representation of an apparatus for practicing the process of the invention.

Referring to FIG. 1, crimped continuous filament yarn 11 is fed by rolls 1 into hollow spindle 7 of an open end spinning rotor which is suspended by bearings 3 and is driven by belt 8. Staple sliver 17 is fed by rolls 16 into opening roller 15 which separates the individual staple fibers 12 from the sliver and delivers them along with an inwardly-directed current of air into consolidating groove 18 of rotor 4. Staple fibers 12 are packed by centrifugal force into consolidating groove 18 and are twisted into a coherent staple yarn 19 by the revolving of rotor 4 as yarn 19 is drawn away from groove 18 by rolls 2. The twisting of staple yarn 19 is assisted by false twist generated by friction as it contacts navel 20 attached to the entrance end of stationary doffing tube 5. Staple yarn 19 is plied with continuous filament yarn 11 at navel 20 to form a ply-twisted combined yarn 13. The speed of rolls 2 in relation to rolls 1 determines the tension on continuous filament yarn 11, which in turn determines whether the plying is balanced.

Figure 2:
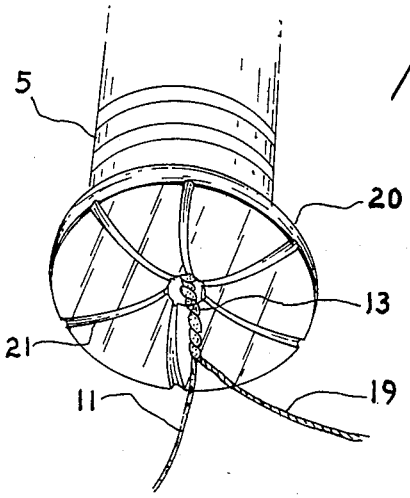
FIG. 2 is a schematic representation of a perspective view of a navel, useful in practicing the process of the invention.

FIG. 2 is a perspective view of navel 20, where continuous filament yarn 11 plies with staple yarn 19. Navel 20 is preferably made of ceramic or other wear-resistant material having a suitable coefficient of friction with staple yarn 19. Navel 20 has groove 21 which may be of various numbers and depth may either approach the axis of doffing tube 5 along a plane of the axis or spirally.

Figure 3:
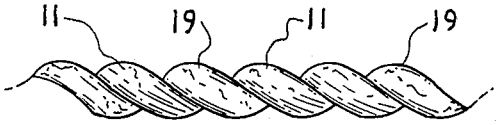
FIG. 3 is a schematic representation of the product by the process of the invention.

FIG. 3 shows a typical combined yarn of the invention in which the ply twists of continuous filament yarn 11 and staple yarn 19 are substantially balanced.

TEST METHODS

Differential Length Test

Figure 4:
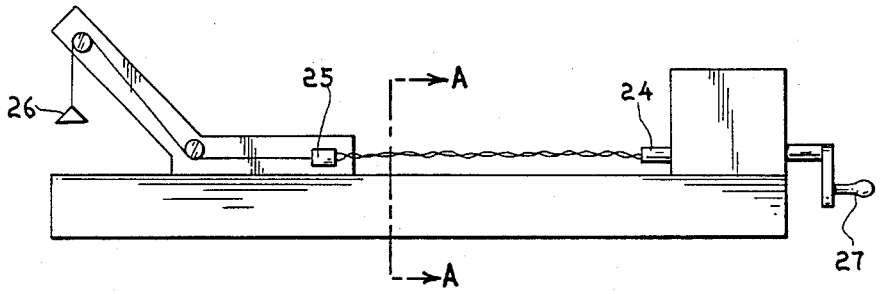
FIG. 4 shows a twist tester used for determining the degree of twist in yarns of the invention.
Figure 5:
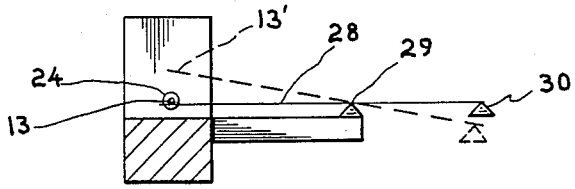
FIG. 5 is a device used in conjunction with the tester of FIG. 4 for determining differential length of the two yarn components.

The differential lengths of the two plied components when unplied are measured on a Precision Twist Tester manufactured by the Alfred Suter Co., Inc., Orangeburg, N.Y., U.S.A. One end of a sample of plied yarn 13 is placed in rotatable clamp 24 of the device shown in FIG. 4 and clamp 25 is attached to the other end of the sample 20 inches (50.8 cm) from clamp 24. Clamp 25 is tensioned by weight 26 at 20 gms and is free to slide axially while being restrained from twisting. Crank 27 is then turned in a direction to unwrap the ply twist until all of the twist is removed. The number of turns required to reach this condition is registered on a counter. Clamp 25 moves outwardly as the yarn is untwisted, and the new yarn length is measured as $L_2$. The position of clamp 25 is then fixed, the two plies are separated slightly, and the end of a lever 28 is placed under one of the plies at the middle of the sample length, L2/2, as shown in FIG. 5, which is in an end view A—A of the arrangement FIG. 4. Lever 28 is pivoted at point 29 and is weighted at end 30 to apply an upward force of 0.066 gms to yarn 13. The upward displacement D of yarn 13 from its original position to a new position 13' is measured and the length of yarn is calculated by the following formula:

$$L_3 = 2((L_2/2)^2 + D^2)^{\frac{1}{2}}$$

The length $L_3$ of the other component is measured similarly, the above measurements are repeated on 3 samples of each yarn and are averaged to obtain $L_{3s}$ of the staple and $L_{3c}$ of the continuous filament yarn. The percent differential length is then calculated as follows:

$$\% \text{ Differential} = 100\frac{L_{3c} - L_{3s}}{L_2}$$

Staple Yarn Tenacity Test

After the above test has been completed, the continuous filament component is cut out of the sample near both end clamps and the staple component is retwisted to its condition at the start of the above test. The sample is then removed from the clamps and is inserted in an Instron or similar tenacity tester while both ends of the sample are held to preserve the twist. The distance between clamps of the tenacity tester is the same as $L_2$ of the above test. Three samples of each yarn are tested and the results are averaged.

Rolling Chair Abrasion Test

Carpet testing apparatus made by Freingarte, Bamberg, Federal Republic of Germany, which simulates the abrasion and crushing action of office chair rollers, is used to evaluate carpet samples made from yarns of the present invention. The procedure is in accordance with German performance test DIN-54324 recommended for the "German Carpet Label", Teppich Forschung-Institut, Aachen.

Fibers Per Cross Section Determination

The total denier of the staple portion of the combined yarn is determined by conventional measuring and weighing method. The denier of the individual staple fibers is also determined by conventional methods, then the total denier is divided by the denier per fiber to determine the average number of fibers per cross section for the particular lengths of yarn employed.

EXAMPLES

Examples 1–3

A series of yarns is prepared by the method of the present invention and by two other methods. Control A is prepared by a method known as wrap spinning in which a small continuous filament yarn is wrapped tightly around a much larger untwisted staple fiber assemblage to give a yarn having a sufficient tensile strength to be tufted into carpet backing as a result of the strength of the continuous filament yarn supplemented by the interfiber friction contributed by the compressive effect of the wrapped continuous filament yarn. Control B is a ring spun 100% staple yarn made by conventional twisting in which the fiber migration from core to surface of the staple yarn and back plus the twist contribute interfiber friction. Processes of the present invention are used to make the yarns of Examples 1–3 in which continuous filament yarns are plied with staple open end spinning apparatus of FIG. 1. The staple fibers of Examples 1 and 2 and Controls A and B are bright nylon of trilobal cross section, 2.3 modification ratio, 100 mm cut length with the staple fibers of Example 3 differing only in being 75 mm cut length. Materials and processing conditions are chosen which produce final yarns of 2778-2940 dTex. Operating conditions and yarn properties are shown in Table 1.

The yarns are tufted into carpet backing to form ⅛-inch gauge velour cut-pile carpet of 7 mm pile height, 700 g/m$^2$.

The yarn of Example 3 is tufted at slightly higher number of stitches per 10 cm to compensate for the lower final yarn count of this item. The carpet samples are then subjected to the roller chair test. A rating of about 22.5–23 or better on a scale of 1–35 is considered commercially satisfactory.

It can be seen that the roller chair test rating of all examples is equal to or better than the ring spun control. However, a major advantage of the process of the present invention can be seen in the great differences in yarn delivery speeds, the present process delivering product at about 5 to 10 times the speed of ring spinning. This results in greater machine productivity and lower product cost.

As to the quality of the yarn product, the lower evenness values (% coeff. of variation) shows that the yarns of Examples 1 and 2 are considerably more uniform than the ring spun control.

Examples 4–9

Controls C-E and Examples 4–9 demonstrate differences in operability between the process of the present invention for making plied yarns and rotor spinning of single staple yarns. In making Control C 18.3 dTex/fiber (16.5 denier per fiber) nylon staple fibers of approximately 4-inch (100 mm) cut length are fed into an open end spinning unit of FIG. 1 and removed at a take away speed sufficiently low that the staple yarn receives enough twist to withstand the centrifugal force on it and avoid breaking. The speed of staple sliver feed rolls 16 are adjusted to give a little more than 120 staple fibers per cross section. The take away speed is then increased until the staple yarn breaks, and the speed at which this occurs is recorded. The procedure is repeated two additional times and the three speed values are averaged. Mechanical twist (in turns per inch) is then calculated as follows:

Mechanical Twist (tpi) = Rotor Speed (in rpm)/Avg. take away speed (in mpm × 39.37)

Figure 6:
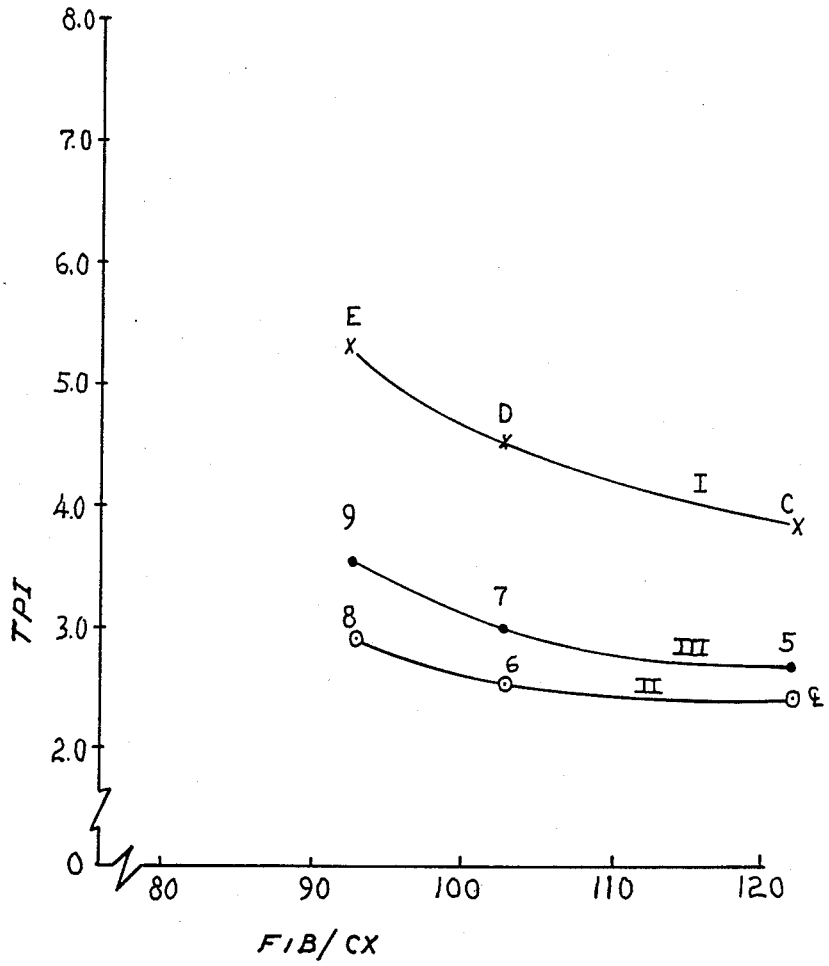
FIG. 6 is a plot of Staple Fibers per Cross Section vs. Mechanical Twist in turns per inch, Curve I showing the limit of operability for staple alone, Curve II showing the limit for staple plus BCF and Curve III showing approximately practical conditions for those particular yarn counts.

Data for these Examples are recorded in Table 2 and are plotted on the graph of FIG. 6.

At the same machine settings, 1244 dTex (1120 denier) 68 filament Du Pont Type 646 bulked continuous filament yarn is then fed through the center at 2% overfeed and plied with the staple yarn, and it is found that the process will operate quite satisfactorily at this take-away speed. The take-away speed is then increased further until the staple yarn breaks and the average maximum speed is determined as above, the staple feed being adjusted to maintain slightly over 120 fibers per cross section. This is Example 4. The take-away speed is then reduced to a level at which the process will operate consistently, Example 5.

The staple feed rate is then reduced in two stages and the remainder of the Controls and Examples are generated in a similar manner to those above. From the upper curve at FIG. 6, which defines the lowest twist levels at which staple alone can operate, it can be seen that higher twist is needed at all fibers per cross section levels. Comparing the lower curve to the upper, the continuous filament and, staple yarn will operate at about half the mechanical twist levels of staple alone. The area within points C, E, 4 and 8 in FIG. 6 defines the region for the given fiber per cross section range in which the mechanical twist of the combined yarn is less than the mechanical twist at break of a staple yarn rotor spun separately at the same machine settings.

The take away speeds are substantially higher for the plied yarns. It can be seen from Table 2 that take-away speeds of practicable Examples 5, 7 and 9 are about 5 times or more than that of ring spun Control B.

Examples 10–14

Controls F–O, X and Y and Examples 10–14 show the importance of navel design in making combined yarns of the invention. Staple Controls F–J and combined yarn Examples 10–14 were made with a grooved navel as shown in FIG. 2 but with 8 grooves instead of 6. Data are shown in Table 3. The staple and BCF are the same as in Examples 4–9. The continuous filament yarn is overfed 2%, and the procedure for determining maximum take-away speed is the same as in the previous Examples.

Figure 7:
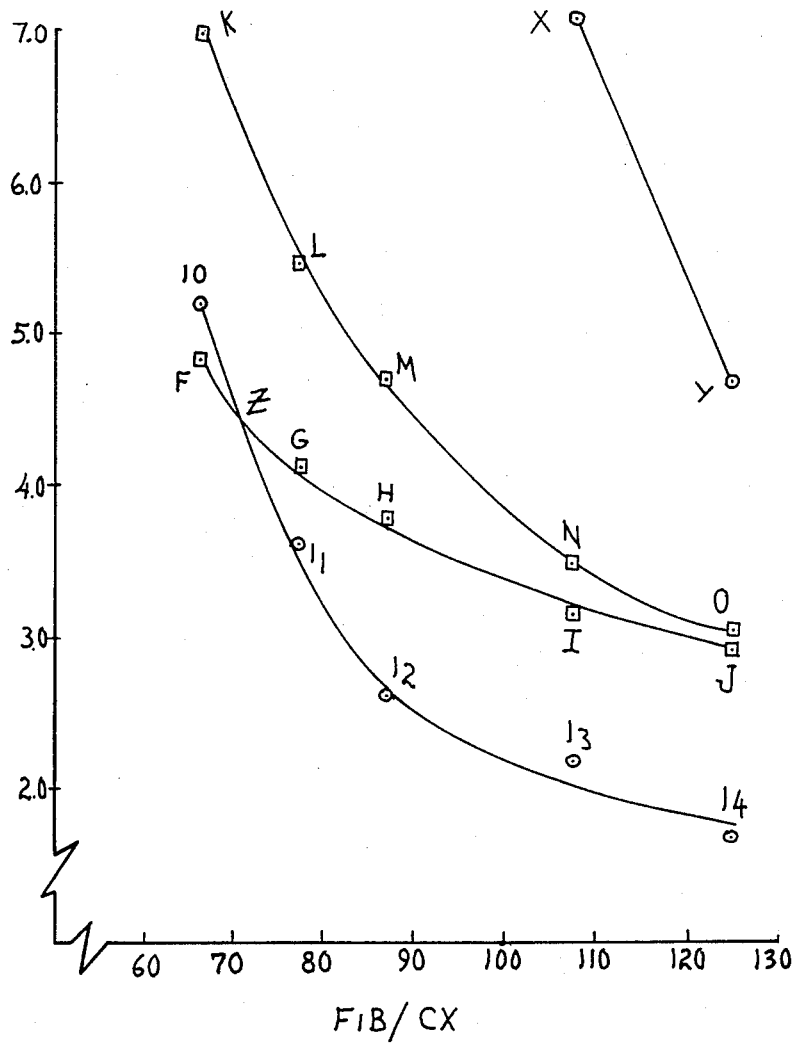
FIG. 7 shows lower limits of operability using navels of two different characteristics.

It can be seen in FIG. 7 and Table 3 that the combined yarn Examples can operate with considerably lower twist at higher take-away speeds than the staple Controls. The area within points J, Z and 14 in FIG. 7 defines the region for the given Fiber/CX range in which the mechanical twist of the combined yarn is less than the mechanical twist at break of a staple yarn rotr spun separately at the same machine settings.

Staple Controls K-O and Controls X and Y were made with a navel having the same shape as Examples 10–14 but without grooves. Data are shown in Table 4. At the higher number of Fibers/CX, the performance of a smooth navel Control O was nearly the same as a grooved navel in Control J. However, at lower levels of Fibers/CX, the smooth navel required increasingly higher turns of mechanical twist.

When continuous filament yarn is introduced using a navel without grooves, plied yarns Controls X and Y are compared to Controls N and O. It can be seen that Controls X and Y require much higher degrees of twist than the staple Controls, which is opposite to the performance of grooved navels.

Examples 15–18

Four combined yarns are made of different degrees of overfeed (+) or underfeed (−) on the continuous filament yarn and the differential lengths between the continuous filament yarn and the staple components are determined. By controlling the speed of rolls 1 in relation to rolls 2 in FIG. 1, the feed ratio of the continuous filament yarn to staple can be controlled, e.g. if the speeds are equal, the overfeed is 0; if the speed of rolls 1 are greater than rolls 2, then the overfeed is plus. It can be seen in Table 5 that at no overfeed the staple component is slightly longer than the continuous filament yarn. At 4% underfeed, the staple is considerably longer than the continuous filament yarn is at 4% overfeed. Therefore, to produce a balanced yarn, a slight degree of overfeed, about 1–2%, is preferred.

TABLE 1

| | Process | | | | |
|---|---|---|---|---|---|
| | Ex. 1 | Ex. 2 | Ex. 3 | Control A Wrap Spun Parafil | Control B Ring Spun |
| Components: | | | | | |
| Staple | | | | | |
| dTex/Fil. | 20 | 20 | 6.7 | 20 | 20 |
| denier/Fil. | 18 | 18 | 6 | 18 | 18 |
| Continuous Filament | | | | | |
| dTex | 1490 | 77 | 1490 | 78 | |
| denier | 1355 | 70 | 1355 | 70.2 | |
| No. Fils. | 80 | 34 | 80 | 23 | |
| Continuous Filament Material | nylon 66 BCF | "DACRON" flat | nylon 66 BCF | nylon 66 flat | — |
| Rotor Speed- rpm | 17,500 | 17,500 | 17,500 | — | — |
| Yarn Delivery Speed - m/min. | 131 | 185 | 261 | 100 | 26.6 |
| Final Yarn Count | | | | | |
| dTex | 2940 | 2940 | 2778 | 2940 | 2940 |
| denier | 2646 | 2646 | 2500 | 2646 | 2646 |
| Mechanical Twist - | | | | | |
| Turns/meter | 134 | 95 | 67 | 195 | 150 |
| Turns/inch | 3.4 | 2.4 | 1.7 | 4.9 | 3.8 |
| Evenness (% Coeff. of | 12.2 | 18.3 | | 23.0 | 21.4 |

TABLE 1-continued

| | Process | | | | |
|---|---|---|---|---|---|
| | Ex. 1 | Ex. 2 | Ex. 3 | Control A Wrap Spun Parafil | Control B Ring Spun |
| Variation) | | | | | |
| Staple Fibers/CX | 73 | 143 | 192 | 143 | 147 |
| Carpet Tufting - Stitches - 10 cm | 42 | 42 | 44 | 42 | 42 |
| Roller Chair Rating | 26.2 | 23.0 | 26.9 | | 22.7 |

TABLE 2

| Control | C | | | D | | | E | | |
|---|---|---|---|---|---|---|---|---|---|
| Example | | 4 | 5 | | 6 | 7 | | 8 | 9 |
| Components: | | | | | | | | | |
| Staple | x | x | x | x | x | x | x | x | x |
| Continuous Filament | | x | x | | x | x | | x | x |
| Rotor Speed - rpm | | | | | 17,460 | | | | |
| Yarn Delivery Speed m/min. | 115 | 189 | 170 | 99 | 177 | 150 | 85 | 155 | 124 |
| Final Yarn Count | | | | | | | | | |
| dTex | 2211 | 3443 | 3443 | 1873 | 3105 | 3105 | 1678 | 2911 | 2911 |
| denier | 2010 | 3130 | 3130 | 1703 | 2823 | 2823 | 1526 | 2646 | 2646 |
| Staple | | | | | | | | | |
| dTex | 2211 | 2211 | 2211 | 1873 | 1873 | 1873 | 1678 | 1678 | 1678 |
| denier | 2010 | 2010 | 2010 | 1703 | 1703 | 1703 | 1526 | 1526 | 1526 |
| Mechanical Twist | | | | | | | | | |
| tpm | 152 | 92.1 | 103 | 176 | 98.8 | 116 | 205 | 113 | 138 |
| tpi | 3.85 | 2.34 | 2.61 | 4.48 | 2.51 | 2.95 | 5.21 | 2.86 | 3.57 |
| Staple Fibers/cx | 122 | 122 | 122 | 103 | 103 | 103 | 93 | 93 | 93 |
| Staple Yarn Tenacity | 0 | 0 | 0.03 | 0 | 0 | 0.04 | 0 | 0 | 0.04 |

TABLE 3

| Control | F | | G | | H | | I | | J |
|---|---|---|---|---|---|---|---|---|---|
| Example | | 10 | | 11 | | 12 | | 13 | |
| Components: | | | | | | | | | |
| Staple | x | x | x | x | x | x | x | x | x |
| Continuous Filament | | x | | x | | x | | x | |
| Rotor Speed - rpm | | | | | 17,500 | | | | |
| Navel | | | | | 8 Grooves | | | | |
| Yarn Take-Away Speed m/min. | 92 | 86 | 108 | 123 | 118 | 170 | 142 | 204 | 155 |
| Final Yarn Count | | | | | | | | | |
| dTex | 1207 | 2451 | 1424 | 2668 | 1580 | 2824 | 1965 | 3209 | 2275 |
| denier | 1086 | 2206 | 1282 | 2401 | 1422 | 2542 | 1768 | 2888 | 2048 |
| Staple | | | | | | | | | |
| dTex | 1207 | 1207 | 1424 | 1424 | 1580 | 1580 | 1965 | 1965 | 2275 |
| denier | 1086 | 1086 | 1282 | 1282 | 1422 | 1422 | 1768 | 1768 | 2048 |
| Mechanical Twist | | | | | | | | | |
| tpm | 190 | 204 | 165 | 142 | 148 | 102 | 123 | 85.8 | 112 |
| tpi | 4.83 | 5.17 | 4.12 | 3.61 | 3.77 | 2.60 | 3.13 | 2.18 | 2.87 |
| Staple Fibers/cx | 66 | 66 | 78 | 78 | 87 | 87 | 108 | 108 | 125 |

TABLE 4

| Control | K | L | M | N | X | O | |
|---|---|---|---|---|---|---|---|
| Components: | | | | | | | |
| Staple | x | x | x | x | x | x | |
| Continuous Fil. | | | | | x | | |
| Rotor Speed | | | | 17,500 | | | |
| Navel | | | | No Grooves | | | |
| Yarn Take-Away Speed m/min. | 64 | 82 | 95 | 128 | 63 | 148 | |
| Final Yarn Count | | | | | | | |
| dTex | 1207 | 1424 | 1580 | 1965 | 3209 | 2275 | 35 |
| denier | 1086 | 1281 | 1422 | 1768 | 2888 | 2048 | 31 |
| Staple | | | | | | | |
| dTex | 1207 | 1424 | 1580 | 1965 | 1965 | 2275 | 22 |
| denier | 1086 | 1281 | 1422 | 1768 | 1768 | 2048 | 20 |
| Mechanical Twist | | | | | | | |
| tpm | 274 | 214 | 184 | 137 | 278 | 118 | 1 |
| tpi | 6.95 | 5.44 | 4.68 | 3.47 | 7.06 | 3.00 | |

TABLE 4-continued

| Control | K | L | M | N | X | O | |
|---|---|---|---|---|---|---|---|
| Staple Fibers/ CX | 66 | 78 | 87 | 108 | 108 | 125 | 1 |

TABLE 5

| Example | 15 | 16 | 17 | 18 |
|---|---|---|---|---|
| % Overfeed on BCF | 0 | +2 | +4 | −4 |
| & Differential | −0.018 | +0.053 | +0.145 | −3.73 |

(+ = Continuous Filament longer)
(− = Staple longer)

What is claimed is:

1. A combined yarn suitable for use in carpets and upholstery having continuous filament yarn and staple yarn characterized by:
   (a) the staple yarn being open end spun using suitable machine settings and having staple fibers 75–200 mm in length;
   (b) a balanced ply;
   (c) the combined yarn having a mechanical twist of 1.5–7 tpi; and
   (d) the staple fibers having a denier per fiber of 6–34.

2. The combined yarn of claim 1 wherein the staple yarn has less than 120 staple fibers per cross section.

3. The combined yarn of claim 2 wherein in any extended length of the combined yarn the continuous filament yarn is less than 0.4% longer than the staple yarn when the extended length of combined yarn is unplied.

4. The combined yarn of claim 3 wherein the mechanical twist of the combined yarn is 3–4 tpi.

5. The combined yarn of claim 3 wherein the staple yarn has 70–110 staple fibers per cross section.

6. The combined yarn of claim 1 further characterized by the continuous filament yarn being crimped.

7. The combined yarn of claim 1 wherein the staple yarn has fibers 75–140 mm in length.

8. The combined yarn of claim 1 wherein the combined yarn is further characterized by having a mechanical twist of less than the mechanical twist at break of a staple yarn rotor spun separately at the same machine settings.

9. The combined yarn of claim 5 wherein the combined yarn is further characterized by having a mechanical twist of less than the mechanical twist at break of a staple yarn rotor spun separately at the same machine settings.

* * * * *